US007462583B2

(12) United States Patent
Wilk et al.

(10) Patent No.: US 7,462,583 B2
(45) Date of Patent: Dec. 9, 2008

(54) METHOD OF LUBRICATING AN INTERNAL COMBUSTION ENGINE AND IMPROVING THE EFFICIENCY OF THE EMISSIONS CONTROL SYSTEM OF THE ENGINE

(75) Inventors: Melody A. Wilk, Timberlake, OH (US); William B. Chamberlin, III, Kirtland, OH (US); Jack C. Kelley, Chagrin Falls, OH (US); William D. Abraham, Concord Township, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 675 days.

(21) Appl. No.: 10/517,046

(22) PCT Filed: Jun. 5, 2003

(86) PCT No.: PCT/US03/17588

§ 371 (c)(1),
(2), (4) Date: Dec. 3, 2004

(87) PCT Pub. No.: WO03/104620

PCT Pub. Date: Dec. 18, 2003

(65) Prior Publication Data

US 2005/0166868 A1 Aug. 4, 2005

Related U.S. Application Data

(60) Provisional application No. 60/388,111, filed on Jun. 10, 2002.

(51) Int. Cl.
*C10M 137/10* (2006.01)
*C10M 159/12* (2006.01)

(52) U.S. Cl. ..... 508/371; 508/346; 508/354; 508/368

(58) Field of Classification Search ..... 508/346, 508/354, 368, 371; 558/208–210
See application file for complete search history.

(56) References Cited

U.S. PATENT DOCUMENTS 5,726,132 A * 3/1998 Roby et al. ..... 508/287

(Continued)

FOREIGN PATENT DOCUMENTS

| | | |
|---|---|---|
| EP | 1 167 497 | 1/2002 |
| EP | 1 203 806 | 5/2002 |

OTHER PUBLICATIONS

"Balancing Crankcase Lubricant Performance with Catalyst Life," Chamberlin et al., SAE Technical Paper Series 841407, Oct. 8-11, 1984.

(Continued)

*Primary Examiner*—Walter D Griffin
*Assistant Examiner*—Lessanework T Seifu
(74) *Attorney, Agent, or Firm*—David M. Shold; Christopher D. Hilker

(57) ABSTRACT

Internal combustion engines exhibit improved efficiency of the emissions control system by using a lubricating oil composition of a base oil, an alkali or alkaline earth metal-containing detergent; a metal salt of one or more phosphorus-containing compounds represented by the formula (I), wherein $X^1$ and $X^2$ are independently O or S, and $R^1$ and $R^2$ are independently hydrocarbyl groups, the average total number of carbon atoms in $R^1$ and $R^2$ for the one or more phosphorus-containing compounds being at least 10.4; and an acylated nitrogen-containing compound having at least about 10 alphatic carbon atoms and a TBN of at least about 2; the lubricating oil composition being characterized by a phosphorus concentration of up to about 0.12% by weight and the substantial absence of copper, thereby generating a lean-phosphorus containing exhaust gas.

23 Claims, 1 Drawing Sheet

U.S. PATENT DOCUMENTS

| | | | | |
|---|---|---|---|---|
| 5,919,740 | A | 7/1999 | Bloch | |
| 2002/0151442 | A1 * | 10/2002 | Bardasz et al. | 508/232 |

OTHER PUBLICATIONS

"Development and Significance of the Phosphorus Emission Index of Engine Oils," Selby, 13th International Colloquium Tribology—Lubricants, Materials and Lubrication Technische Akademie Esslingen, Stuttgart, Germany, Jan. 15-17, 2002 (accessed at http://www.savantgroup.com/PhosIndex-v2.pdf, site updated Jan. 2003).

* cited by examiner

METHOD OF LUBRICATING AN INTERNAL COMBUSTION ENGINE AND IMPROVING THE EFFICIENCY OF THE EMISSIONS CONTROL SYSTEM OF THE ENGINE

CROSS-REFERENCE TO RELATED APPLICATIONS

This application claims priority from United States Application Provisional Application Ser. No. 60/388,111, filed Jun. 10, 2002.

TECHNICAL FIELD

This invention relates to a method of lubricating an internal combustion engine and improving the efficiency of the emissions control system of the engine.

BACKGROUND OF THE INVENTION

For decades phosphorus in the form of zinc diorgano dithiophosphates (ZDDPs) has been used as extreme pressure (EP) and antiwear additives in engine oils. A problem with the use of phosphorus, however, is that it contaminates emissions control systems catalysts and thereby reduces their effectiveness. In response to this problem, phosphorus concentration has been reduced for some SAE passenger car engine oil classifications. With the introduction of ILSAC GF-1, phosphorus levels were limited to no more than 1200 parts per million (ppm) and with GF-3 to 1000 ppm. Even at these levels of phosphorus, however, catalyst contamination is still an issue. The problem therefore is to provide adequate engine lubrication and at the same time reduce catalyst contamination. The present invention provides a solution to this problem.

SUMMARY OF THE INVENTION

This invention relates to a method of lubricating an internal combustion engine and improving the efficiency of the emissions control system of the engine, the emissions control system being equipped with a catalyst containing exhaust gas after treatment device, the method comprising:

(A) selecting a lubricating oil composition comprising: a base oil; an alkali or alkaline earth metal-containing detergent; a metal salt of one or more phosphorus-containing compounds represented by the formula

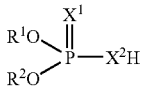

(I)

wherein in formula (I), $X^1$ and $X^2$ are independently O or S, and $R^1$ and $R^2$ are independently hydrocarbyl groups, the average total number of carbon atoms in $R^1$ and $R^2$ for the one or more phosphorus-containing compounds being at least 10.4; and an acylated nitrogen containing compound having at least about 10 aliphatic carbon atoms and a TBN of at least about 2; the lubricating oil composition being characterized by a phosphorus concentration of up to about 0.12% by weight and the substantial absence of copper;

(B) adding the lubricating oil composition to the engine;

(C) operating the engine;

(D) generating a lean-phosphorus containing exhaust gas; and (E) contacting the catalyst in the exhaust gas after treatment device with the lean-phosphorus containing exhaust gas.

DETAILED DESCRIPTION OF THE INVENTION

Figure 1:
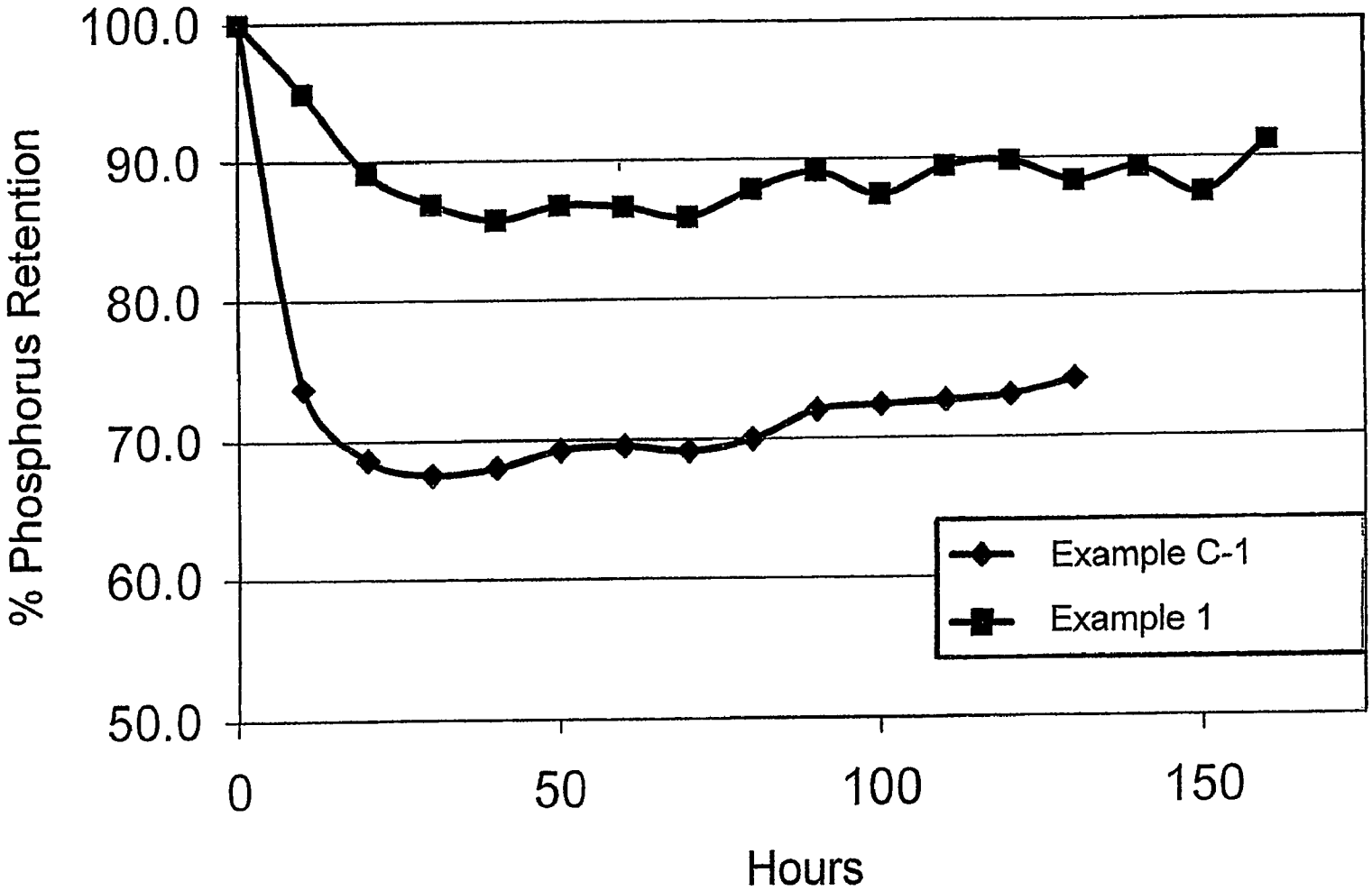
FIG. 1 is a plot of the percent phosphorus retention vs. time observed for Examples C-1 and 1.

The term "hydrocarbyl," when referring to groups attached to the remainder of a molecule, refers to groups having a purely hydrocarbon or predominantly hydrocarbon character within the context of this invention. Such groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, will be present for each 10 carbon atoms in the hydrocarbyl group.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about 0.5 gram per liter at 25° C.

The term "TBN" refers to total base number. This is the amount of acid (perchloric or hydrochloric) needed to neutralize all or part of a material's basicity, expressed as milligrams of KOH per gram of sample.

The term "high molecular weight phosphorus containing compound" refers to one or more compounds represented by formula (I) wherein the average total number of carbon atoms in $R^1$ and $R^2$ for the one or more compounds is at least 10.4, and in one embodiment, at least 10.8.

The term "low molecular weight phosphorus containing compound" refers to one or more compounds represented by formula (I) wherein the average total number of carbon atoms in $R^1$ and $R^2$ for the one or more compounds is less than 10.4.

The term "lean-phosphorus containing exhaust gas" refers to an exhaust gas that is generated in an internal combustion engine lubricated with a lubricating oil composition containing a metal salt of a high molecular weight phosphorus containing compound, the exhaust gas having a relatively low concentration of phosphorus when compared to an exhaust gas generated under the same conditions using the same lubricating oil composition containing the same level of phosphorus except that the phosphorus containing compound is a low molecular weight phosphorus containing compound.

The term "substantial absence of copper" refers to the fact that copper is not intentionally added to the lubricating oil composition used with the inventive method and, if present, is present as an impurity, the concentration of this impurity at the time the lubricating oil composition is added to the engine being no more than about 10 ppm, and in one embodiment no more than about 5 ppm, and in one embodiment no more than about 2 ppm.

The term "substantial absence of magnesium" refers to the fact that, in one embodiment of the invention, magnesium is not intentionally added to the lubricating oil composition used with the inventive method and, if present, is present as an impurity, the concentration of this impurity at the time the lubricating oil composition is added to the engine being no more than about 100 ppm, and in one embodiment no more than about 50 ppm, and in one embodiment no more than about 25 ppm, and in one embodiment no more than about 15 ppm.

The Inventive Method

The inventive method provides for lubricating an internal combustion engine while at the same time improving the efficiency of the emissions control system used with the engine. The lubricating oil composition is selected from those lubricating oil compositions that generate a lean-phosphorus containing exhaust gas during operation of the engine. The lean-phosphorus containing exhaust gas is advanced to the emissions control system. In the emissions control system the lean-phosphorus containing exhaust gas contacts the catalyst used in the exhaust gas after treatment device. The phosphorus in the lean-phosphorus containing exhaust gas contaminates the catalyst and thereby reduces its efficiency. However, since the level of phosphorus in the lean-phosphorus containing exhaust gas is at a reduced level, the amount of contamination of the catalyst is reduced. This reduction in contamination results in an improvement in the efficiency of the emissions control system.

The generation of a lean-phosphorus containing exhaust gas is dependent on proper selection of the lubricating oil composition used to lubricate the engine. The lubricating oil composition used with the inventive method contains an alkali or alkaline earth metal containing detergent, a metal salt of at least one phosphorus-containing compound represented by formula (I), and an acylated-nitrogen containing compound. This combination of additives, at least in one embodiment of the invention, provides a synergistic combination resulting in a reduction in the volatility of the phosphorus used in the lubricating oil composition. Additional optional nitrogen-containing compounds (e.g., antioxidants) when present may also contribute to this synergistic effect. This reduction in phosphorus volatility provides for the generation of a lean-phosphorus containing exhaust gas with the inventive method. In one embodiment of the invention, the weight ratio of detergent metal to phosphorus in the lubricating oil composition at the time the lubricating oil composition is added to the engine is from about 0.5:1 to about 10:1, and in one embodiment about 2:1 to about 4:1, and in one embodiment about 2.5:1 to about 3:1. In one embodiment, the weight ratio of nitrogen to phosphorus in the lubricating oil composition at the time the lubricating oil composition is added to the engine is about 0.3:1 to about 4:1, and in one embodiment about 0.5:1 to about 2:1, and in one embodiment about 1:1 to about 1.5:1.

The amount of phosphorus in the exhaust gas during the operation of the engine is indirectly proportional to the amount of phosphorus retained in the lubricating oil composition in the crankcase. The amount of phosphorus retained in the crankcase can be calculated from the following formula:

$$\%\ P_{retention} = \left[\frac{(\%\ \text{wt}\ P_{drain})(\%\ \text{wt}\ M_{new})}{(\%\ \text{wt}\ P_{new})(\%\ \text{wt}\ M_{drain})}\right] \times 100$$

wherein: % wt $P_{drain}$ is the percent by weight of phosphorus in the lubricating oil composition in the crankcase at the end of a drain interval; % wt $M_{new}$ is the percent by weight of detergent metal in the lubricating oil composition in the crankcase at the beginning of the drain interval; % wt $P_{new}$ is the percent by weight of phosphorus in the lubricating oil composition in the crankcase at the beginning of the drain interval; and % wt $M_{drain}$ is the percent by weight of detergent metal in the lubricating oil composition at the end of the drain interval. In one embodiment of the invention, the amount of phosphorus retained in the crankcase oil of the engine after a 12000 kilometer (7500 mile) drain cycle is at least about 80% by weight, and in one embodiment at least about 84% by weight, and in one embodiment at least about 88% by weight, and in one embodiment at least about 92% by weight, and in one embodiment at least about 95% by weight, and in one embodiment at least about 98% by weight. In one embodiment of the invention, the amount of phosphorus lost from the crankcase oil with the exhaust gas over a 7500 mile (12000 kilometer) drain cycle is about 20% by weight or less, and in one embodiment about 16% by weight or less, and in one embodiment about 12% by weight or less, and in one embodiment about 8% by weight or less, and in one embodiment about 5% by weight or less, and in one embodiment about 2% by weight or less.

It has been unexpectedly discovered that the use of copper in the lubricating oil composition tends to increase the volatility of the phosphorus used therein. Accordingly, at the time the lubricating oil composition used with the inventive method is added to the engine it is characterized by the substantial absence of copper.

It has also been unexpectedly discovered, at least in one embodiment of the invention, that the use of magnesium in the lubricating oil composition tends to increase the volatility of the phosphorus used therein. Accordingly, in one embodiment of the invention, at the time the lubricating oil composition used with the inventive method is added to the engine it is characterized by the substantial absence of magnesium.

The Internal Combustion Engine

The internal combustion engine that may be operated in accordance with the invention may be any internal combustion engine that is equipped with an emissions control system that utilizes a catalyst containing exhaust gas after treatment device. These include engines that employ a closed crankcase system and positive crankcase ventilation. The internal combustion engine may be a spark-ignited or a compression-ignited engine. These engines include automobile and truck engines, two-cycle engines, aviation piston engines, marine and railroad diesel engines, and the like. Included are on- and off-highway engines. The compression-ignited engines include those for both mobile and stationary power plants. The compression-ignited engines include those used in urban buses, as well as all classes of trucks. The compression-ignited engines may be of the two-stroke per cycle or four-stroke per cycle type. The compression-ignited engines include heavy duty diesel engines.

The exhaust gas after treatment device may be referred to as a catalytic converter and may be of any conventional design. The exhaust after treatment device may be comprised of flow-through passages of ceramic or metal coated with a washcoat comprised of zeolite, $Al_2O_3$, $SiO_2$, $TiO_2$, $CeO_2$, $ZrO_2$, $V_2O_5$, $La_2O_3$, or mixtures of two or more thereof, the washcoat supporting a catalyst selected from the group consisting of Pt, Pd, Rh, Ir, Ru, V, Cr, Mn, Fe, Co, Ni, Cu, Zn, Ag, Ce, Ga, or a mixture of two or more thereof.

The Lubricating Oil Composition.

The lubricating oil composition used in accordance with the inventive method is comprised of one or more base oils which are generally present in a major amount. The base oil may be present in an amount greater than about 60%, and in one embodiment greater than about 70%, and in one embodiment greater than about 80% by weight, and in one embodiment greater than about 85% by weight of the lubricating oil composition. The lubricating oil composition contains: an alkali or alkaline earth metal containing detergent; a metal salt of at least one phosphorus-containing compound represented by formula (I) which typically functions as an antiwear agent, EP additive, corrosion inhibitor and/or antioxidant; and an acylated-nitrogen containing compound which typically functions as a dispersant. The lubricating oil composition may contain other additives known in the art.

The lubricating oil composition may have a viscosity of up to about 16.3 $mm^2/s$ (cSt) at 100° C., and in one embodiment about 5 to about 16.3 $mm^2/s$ (cSt) at 100° C., and in one embodiment about 6 to about 13 $mm^2/s$ (cSt) at 100° C.

The lubricating oil composition may have an SAE Viscosity Grade of 0W, 0W-20, 0W-30, 0W-40, 0W-50, 0W-60, 5W, 5W-20, 5W-30, 5W-40, 5W-50, 5W-60, 10W, 10W-20, 10W-30, 10W-40 or 10W-50. The viscosity grade may be SAE 15W-40, SAE 20, SAE 30, SAE 40 or SAE 20W-50.

The lubricating oil composition may be characterized by a sulfur content of up to about 1% by weight, and in one embodiment up to about 0.5% by weight.

The lubricating oil composition may be characterized by a phosphorus content of up to about 0.12% or up to about 0.10% or up to about 0.08% or up to about 0.05% by weight, and in one embodiment about 0.03 to about 0.12% by weight, and in one embodiment about 0.03 to about 0.10% by weight, and in one embodiment about 0.03 to about 0.08% by weight, and in one embodiment about 0.03 to about 0.05% by weight.

The ash content of the lubricating oil composition as determined by the procedures in ASTM D-874-96 may be in the range of about 0.3 to about 1.4% by weight, and in one embodiment about 0.3 to about 1.2% by weight, and in one embodiment about 0.3 to about 1.0% by weight.

The lubricating oil composition may be characterized by a chlorine content of up to about 100 ppm, and in one embodiment up to about 50 ppm, and in one embodiment up to about 10 ppm.

The Base Oil

The base oil used in the lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≦0.03 | and | ≧90 | 80 to 120 |
| Group III | ≦0.03 | and | ≧90 | ≧120 |
| Group IV | All polyalphaolefins (PAOs) | | | |
| Group V | All others not included in Groups I, II, III or IV | | | |

Groups I, II and III are mineral oil base stocks.

The base oil may be a natural oil, synthetic oil or mixture thereof. The natural oils include animal oils and vegetable oils (e.g., castor oil, lard oil) as well as mineral lubricating oils such as liquid petroleum oils and solvent treated or acid-treated mineral lubricating oils of the paraffinic, naphthenic or mixed paraffinic-naphthenic types. Oils derived from coal or shale are also useful.

Synthetic oils include hydrocarbon oils such as polymerized and interpolymerized olefins, alkylbenzenes, polyphenyls, alkylated diphenyl ethers, alkylated diphenyl sulfides, and derivatives, analogs and homologs thereof. The synthetic oils include alkylene oxide polymers and interpolymers and derivatives thereof where the terminal hydroxyl groups have been modified by esterification, etherification, etc.; esters of dicarboxylic acids (e.g., phthalic acid, succinic acid, alkyl succinic acids, alkenyl succinic acids, etc.) with a variety of alcohols (e.g., butyl alcohol, hexyl alcohol, dodecyl alcohol, 2-ethylhexyl alcohol, ethylene glycol, etc.); and esters made from $C_5$ to $C_{12}$ monocarboxylic acids and polyols or polyol ethers.

In one embodiment, the base oil may be a polyalphaolefin (PAO) or an oil derived from Fischer-Tropsch synthesized hydrocarbons. In other embodiments Group II or group III oils or mixtures thereof can be used, as well as Group III or mixtures of Group III and Group IV oils.

Unrefined, refined and rerefined oils, either natural or synthetic (as well as mixtures of two or more of any of these) of the type disclosed hereinabove can be used as the base oil.

The Alkali or Alkaline Earth Metal Containing Detergent

The alkali metal or alkaline earth metal containing detergent may be an alkali or alkaline earth metal salt of an acidic organic compound. The acidic organic compound may be an organic sulfur acid, carboxylic acid or derivative thereof, phenol or hydrocarbyl substituted saligenin. The acidic organic compound may be a linear oligomer or polymer containing unsubstituted or substituted phenol units and unsubstituted or substituted salicylic acid units. These salts may be neutral or overbased. The former contain an amount of metal cation just sufficient to neutralize the acidic groups present in the salt anion; the latter contain an excess of metal cation and are often termed basic, overbased, hyperbased or superbased salts. These salts may have a TBN in the range of about 30 to about 460, and in one embodiment about 100 to about 400, and in one embodiment about 200 to about 400, and in one embodiment about 300 to about 400.

The organic sulfur acids may be oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids. The sulfonic acids include the mono- or poly-nuclear aromatic or cycloaliphatic compounds.

The carboxylic acids include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least about 8 carbon atoms, and in one embodiment at least about 12 carbon atoms. Usually they have no more than about 400 carbon atoms. The cycloaliphatic and aliphatic carboxylic acids can be saturated or unsaturated.

A useful group of carboxylic acids are the oil-soluble aromatic carboxylic acids. These acids may be represented by the formula:

$$(R^*)_a\text{-}Ar^*(CXXH)_m \qquad \text{(II)}$$

wherein in Formula (II), R* is an aliphatic hydrocarbyl group of about 4 to about 400 carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least about 8 aliphatic carbon atoms provided by the R* groups for each acid molecule.

A useful group of carboxylic acids are the aliphatic-hydrocarbon substituted salicylic acids wherein each aliphatic hydrocarbon substituent contains an average of at least about 8 carbon atoms, and in one embodiment at least about 16 carbon atoms per substituent, and the acids contain one to three substituents per molecule. A useful aliphatic-hydrocarbon substituted salicylic acid is $C_{16}$-$C_{18}$ alkyl salicylic acid. A group of carboxylic acid derivatives that are useful are the lactones represented by the formula (III)

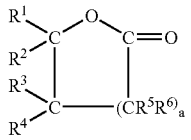

wherein in Formula (III), $R^1$, $R^2$, $R^3$, $R^4$, $R^5$ and $R^6$ are independently H, hydrocarbyl groups or hydroxy substituted hydrocarbyl groups of from 1 to about 30 carbon atoms, with the proviso that the total number of carbon atoms must be sufficient to render the lactones oil soluble; $R^2$ and $R^3$ can be linked together to form an aliphatic or aromatic ring; and a is a number in the range of zero to 4. A useful lactone can be prepared by reacting an alkyl (e.g., dodecyl) phenol with glyoxylic acid at a molar ratio of about 2:1.

Neutral and basic salts of phenols (generally known as phenates) are also useful in the compositions of this invention and well known to those skilled in the art. The phenols from which these phenates are formed are of the general formula $$(R^*)_a\text{-}(Ar^*)\text{-}(OH)_m \quad \text{(IV)}$$

wherein in Formula (IV), R*, a, Ar*, and m have the same meaning as described hereinabove with reference to Formula (II).

The hydrocarbyl-substituted saligenins may be represented by the formula (V)

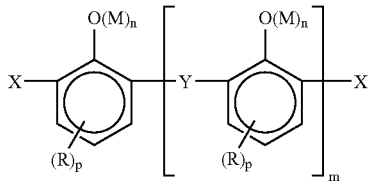

wherein in Formula (V): each X independently is —CHO or —$CH_2OH$; each Y independently is —$CH_2$— or —$CH_2OCH_2$—; wherein the —CHO groups comprise at least about 10 mole percent of the X and Y groups; each M is independently a valence of an alkali or alkaline earth metal ion; each R is independently a hydrocarbyl group containing 1 to about 60 carbon atoms; m is 0 to about 10; n is 0 or 1 provided that when n is 0 the M is replaced with H; and each p is independently 0, 1, 2, or 3; provided that at least one aromatic ring contains an R substituent and that the total number of carbon atoms in all R groups is at least 7; and further provided that if m is 1 or greater, then one of the X groups can be —H. n may have an average value of about 0.1 to about 10, and in one embodiment about 2 to about 9. Each R may contain about 7 to about 28 carbon atoms, and in one embodiment about 9 to about 18 carbon atoms.

The linear oligomers or polymers containing phenol units and salicylic units may contain m units of formula (VI-A)

(VI-A)

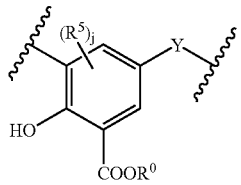

and n units of the formula (VI-B)

(VI-B)

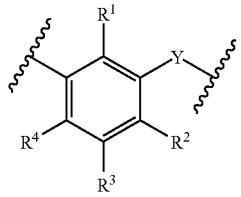

joined together, each end of the compound having a terminal group which is independently one of the following (VI-C)

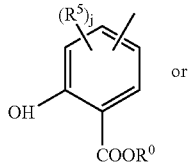

or (VI-D)

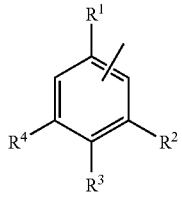

wherein in formulae (VI-A) to (VI-D): Y is a divalent bridging group which may be the same or different in each unit; $R^0$ is hydrogen or a hydrocarbyl group; $R^5$ is hydrogen or a hydrocarbyl; j is 1 or 2; $R^3$ is hydrogen, a hydrocarbyl or a hetero-substituted hydrocarbyl group; either $R^1$ is hydroxyl and $R^2$ and $R^4$ are independently either hydrogen, hydrocarbyl or hetero-substituted hydrocarbyl, or $R^2$ and $R^4$ are hydroxyl and $R^1$ is either hydrogen, hydrocarbyl or hetero-substituted hydrocarbyl; and the number of units of structures VI-A and VI-B is at least 1. In one embodiment, m is at least 1; n is at least 2; the ratio of m to n ranges from about 0.1:1 to about 2:1; the total of m+n is at least 3. The total of m+n may range from 3 to about 50, and in one embodiment 3 to about 20. The ratio of m to n may range from about 0.1:1 to about 1:1, and in one embodiment about 0.1:1 to about 0.5:1. Each Y may independently be represented by the formula $(CHR^6)_d$ in which $R^6$ is either hydrogen or hydrocarbyl and d is an integer which is at least 1. In one embodiment, $R^6$ contains 1 to about 6 carbon atoms. In one embodiment, d is from 1 to about 4. Y may optionally be sulfur rather than $(CHR^6)_d$ in up to 50% of the units, such that the amount of sulfur incorporated in the molecule is up to 50 mole % of the Y groups. In one embodiment, the amount of sulfur is between 8 and 20 mole %, and in one embodiment the compound is sulfur-free. $R^0$ may be a hydrocarbyl (e.g., alkyl) group of 1 to about 6 carbon atoms. $R^5$ may be a hydrocarbyl group of 1 to about 100 carbon atoms, and in one embodiment 1 to about 30 carbon atoms, and in one embodiment 1 to about 6 carbon atoms. $R^3$ may be a hydrocarbyl of 1 to about 100 carbon atoms, and in one embodiment 1 to about 30 carbon atoms. $R^3$ may be hetero-substituted. The hetero atoms or groups may be —O— or —NH—. In one embodiment, Y is $CH_2$; $R^1$ is hydroxyl; $R^2$ and $R^4$ are hydrogen; $R^3$ is a hydrocarbyl group of about 6 to about 60 carbon atoms, and in one embodiment about 6 to about 18 carbon atoms; $R^0$ is hydrogen; $R^5$ is hydrogen; j is 1; and m+n has a value of at least 5; and m is 1 or 2.

Mixtures of two or more neutral or basic metal salts of the hereinabove described acidic organic compounds may be used in the lubricating oil compositions.

The alkali and alkaline earth metals that are useful include sodium, potassium, lithium, calcium, strontium and barium, with sodium, lithium and calcium being especially useful.

It has been unexpectedly discovered, at least in one embodiment of the invention, that the use of sodium in the lubricating oil composition tends to decrease the volatility of the phosphorus used therein significantly. Accordingly, in one embodiment of the invention, the use of sodium as the detergent metal is particularly useful.

It has been unexpectedly discovered, at least in one embodiment of the invention, that the use of magnesium in the lubricating oil composition tends to increase the volatility of the phosphorus used therein. Accordingly, in one embodiment of the invention, the detergent metal is not magnesium.

The alkali or alkaline earth metal containing detergent may be employed in the lubricating oil composition at a concentration in the range of about 0.1 to about 10% by weight, and in one embodiment about 0.2 to about 5% percent by weight, and in one embodiment about 0.3% to about 3% by weight, and in one embodiment about 0.5 to about 2% by weight.

The Phosphorus-Containing Metal Salt

The phosphorus-containing compound useful in making the phosphorus-containing metal salt may be one or more compounds represented by the formula

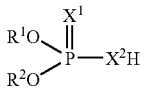

(I)

wherein in Formula (I): $X^1$ and $X^2$ are independently oxygen or sulfur, and $R^1$ and $R^2$ are independently hydrocarbyl groups, the average total number of carbon atoms in $R^1$ and $R^2$ for the one or more phosphorus-containing compounds being at least 10.4, and in one embodiment at least 10.8, and in one embodiment at least about 11, and in one embodiment at least about 11.5, and in one embodiment at least about 12. In one embodiment, the average total number of carbon atoms in $R^1$ and $R^2$ for the one or more phosphorus-containing compounds may be up to about 100, and in one embodiment up to about 60, and in one embodiment up to about 24. In one embodiment less than 34 mole percent of all the $R^1$ and $R^2$ hydrocarbyl groups supplied by all the phosphorus-containing metal salt(s) (especially, zinc dialkylthiophosphates) in the composition contain 4 or fewer carbon atoms or, alternatively, contain 3 or fewer carbons. In other embodiments, less that 40 mole percent or less than 36 or 31 mole percent of all such hydrocarbyl groups contain 4 or fewer or 3 or fewer carbon atoms. $R^1$ and $R^2$ may be independently hydrocarbyl groups of about 3 to about 50 carbon atoms, or about 3 to about 12 or about 3 to about 10 carbon atoms, and in one embodiment about 4 to about 50 carbon atoms, and in one embodiment about 5 to about 50 carbon atoms, and in one embodiment about 6 to about 50 carbon atoms. $R^1$ and $R^2$ may be independently alkyl groups, alkenyl groups, aromatic groups, or mixtures of two or more thereof. $R^1$ and $R^2$ may be derived from one or more primary alcohols, one or more secondary alcohols, or a mixture of at least one primary alcohol and at least one secondary alcohol. In certain embodiments, greater than 60 mole percent, for instance, at least 70 mole percent or at least 73 mole percent, of all the $R^1$ and $R^2$ groups supplied by the phosphorus-containing metal salt are derived from secondary alcohols. $R^1$ and $R^2$ may be the same as each other, although they may be different and either or both may be mixtures. Examples of $R^1$ and $R^2$ include isopropyl, 4-methyl-2-pentyl, isooctyl, 2-ethylhexyl, decyl, dodecyl, tetradecyl, dodecenyl, phenyl, naphthyl, alkylphenyl, alkylnaphthyl, phenylalkyl, naphthylalkyl, alkylphenylalkyl, alkylnaphthylalkyl, and mixtures thereof.

In one embodiment, the phosphorus-containing compound is a dialkyldithiophosphate derived from 4-methyl-2-pentyl alcohol.

In one embodiment, two or more phosphorus-containing compounds are used in the lubricating oil composition and at least about 80% by weight, and in one embodiment at least about 90% by weight, and in one embodiment at least about 95% by weight, and in one embodiment at least about 98% by weight, of the phosphorus present in the lubricating oil composition at the time the lubricating oil composition is added to the engine is present in a compound represented by formula (I) wherein $R^1$ and $R^2$ independently are hydrocarbyl groups (e.g., alkyl or alkenyl) of about 6 to about 18 carbon atoms.

In one embodiment, the following mixture of phosphorus-containing compounds is used: about 70 to about 99 molar percent of a dialkyldithiophosphate derived from 4-methyl-2-pentyl alcohol; and about 1 to about 30 molar percent of a dialkyldithiophosphate derived from an alcohol mixture of about 60% by mole isopropyl alcohol and about 40% by mole 4-methyl-2-pentyl alcohol.

The metal salts of the phosphorus-containing compounds represented by formula (I) include those salts containing Group IA, IIA or IIB metals, aluminum, lead, tin, iron, molybdenum, cobalt, nickel or bismuth. Zinc is an especially useful metal. In one embodiment, the metal is not magnesium. These salts can be neutral salts or overbased salts.

The phosphorus-containing metal salt may be employed in the lubricating oil composition at a concentration sufficient to provide the lubricating oil composition with a phosphorus concentration in the range of up to about 0.12% by weight, and in one embodiment about 0.03 to about 0.12% percent by weight, and in one embodiment about 0.03% to about 0.10% by weight, and in one embodiment about 0.03 to about 0.08% by weight, and in one embodiment about 0.03 to about 0.05% by weight.

The Acylated Nitrogen Containing Compound

The acylated nitrogen containing compound may be made by reacting at least one carboxylic acid acylating agent with an amino compound. The acylating agent may be linked to the amino compound through an imido, amido, amidine or salt linkage. The substituent comprised of at least about 10 aliphatic carbon atoms may be in either the carboxylic acid acylating agent derived portion of the molecule or in the amino compound derived portion of the molecule.

Illustrative substituent groups containing at least about 10 aliphatic carbon atoms include n-decyl, n-dodecyl, tetrapropylene, n-octadecyl, oleyl, chlorooctadecyl, triicontanyl, etc. Generally, these substituents are hydrocarbyl groups made from homo- or interpolymers (e.g., copolymers, terpolymers) of mono- or di-olefins having 2 to about 10 carbon atoms, such as ethylene, propylene, 1-butene, isobutene, butadiene, isoprene, 1-hexene, 1-octene, etc. Typically, these olefins are 1-monoolefins. The substituent may also be derived from the halogenated (e.g., chlorinated or brominated) analogs of such homo- or interpolymers.

A useful source for the substituent groups are poly (isobutene)s obtained by polymerization of a $C_4$ refinery stream having a butene content of about 35 to about 75 weight percent and an isobutene content of about 30 to about 60 weight percent in the presence of a Lewis acid catalyst such as aluminum trichloride or boron trifluoride. These polybutenes contain predominantly isobutene repeating units.

In one embodiment, the substituent is a polyisobutene group derived from a polyisobutene having a high methylvinylidene isomer content, that is, at least about 50% methylvinylidene, and in one embodiment at least about 70% methylvinylidene. Suitable high methylvinylidene polyisobutenes include those prepared using boron trifluoride catalysts.

The acylating agent can vary from formic acid and its acyl derivatives to acylating agents having high molecular weight aliphatic substituents of up to about 5,000, 10,000 or 20,000 carbon atoms. In one embodiment, the acylating agent is a hydrocarbyl substituted succinic acid or anhydride containing hydrocarbyl substituent groups and succinic groups wherein the substituent groups are derived from a polyalkene such as polyisobutene. The acid or anhydride may be characterized by the presence within its structure of an average of at least about 0.9 succinic group for each equivalent weight of substituent groups, and in one embodiment about 0.9 to about 2.5 succinic groups for each equivalent weight of substituent groups. The polyalkene may have number average molecular weight ($\overline{M}n$) of at least about 700, and in one embodiment about 700 to about 3000, and in one embodiment about 900 to about 2200. The ratio between the weight average molecular weight (Mw) and the (Mn) (that is, Mw/Mn) may range from about 1 to about 10, and in one embodiment about 1.5 to about 5, and in one embodiment about 2.5 to about 5. For purposes of this invention, the number of equivalent weights of substituent groups is deemed to be the number corresponding to the quotient obtained by dividing the Mn value of the polyalkene from which the substituent is derived into the total weight of the substituent groups present in the substituted succinic acid or anhydride.

The amino compound may be characterized by the presence within its structure of at least one HN< group and can be a monoamine or polyamine. Mixtures of two or more amino compounds can be used in the reaction with one or more acylating reagents. In one embodiment, the amino compound contains at least one primary amino group (i.e., —$NH_2$). In one embodiment, the amine is a polyamine, for example, a polyamine containing at least two —NH— groups, either or both of which are primary or secondary amines. The amines may be aliphatic, cycloaliphatic, aromatic or heterocyclic amines. Hydroxy substituted amines, such as alkanol amines (e.g., mono- or diethanol amine), and hydroxy (polyhydrocarbyloxy) anologs of such alkanol amines may be used.

Among the useful amines are the alkylene polyamines, including the polyalkylene polyamines. The alkylene polyamines include those represented by the formula

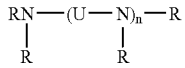

(VII)

wherein in Formula (VII), n is from 1 to about 14; each R is independently a hydrogen atom, a hydrocarbyl group or a hydroxy-substituted or amine-substituted hydrocarbyl group having up to about 30 atoms, or two R groups on different nitrogen atoms can be joined together to form a U group, with the proviso that at least one R group is a hydrogen atom and U is an alkylene group of about 2 to about 10 carbon atoms. U may be ethylene or propylene. Alkylene polyamines where each R is hydrogen or an amino-substituted hydrocarbyl group with the ethylene polyamines and mixtures of ethylene polyamines are useful. Usually n will have an average value of from about 2 to about 10. Such alkylene polyamines include methylene polyamines, ethylene polyamines, propylene polyamines, butylene polyamines, pentylene polyamines, hexylene polyamines, heptylene polyamines, etc. The higher homologs of such amines and related amino alkyl-substituted piperazines are also included.

Alkylene polyamines that are useful include ethylene diamine, diethylene triamine, triethylenel, tetramine, tetraethylene pentamine, pentaethylene hexamine, propylene diamine, trimethylene diamine, hexamethylene diamine, decamethylene diamine, octamethylene diamine, di(heptamethylene) triamine, tripropylene tetramine, trimethylene diamine, di(trimethylene)triamine, N-(2-aminoethyl)-piperazine, 1,4-bis(2-aminoethyl)piperazine, and the like. Higher homologs such as those obtained by condensing two or more of the above-illustrated alkylene amines may be used. Mixtures of two or more of any of the afore-described polyamines may be used.

Useful polyamines include those resulting from stripping polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than about 2% by weight, and in one embodiment less than about 1% by weight material boiling below about 200° C.

The acylated nitrogen containing compounds include amine salts, amides, imides, amidines, amidic acids, amidic salts and imidazolines as well as mixtures thereof. To prepare the acylated nitrogen-containing compounds from the acylating agents and the amino compounds, one or more acylating reagents and one or more amino compounds may be heated, optionally in the presence of a normally liquid, substantially inert organic liquid solvent/diluent, at temperatures in the range of 80° C. up to the decomposition point of any of the reactants or the product but normally at temperatures in the range of about 100° C. to about 300° C., provided 300° C. does not exceed the decomposition point of any of the reactants or the product. Temperatures of about 125° C. to about 250° C. may be used. The acylating agent and the amino compound may be reacted in amounts sufficient to provide from about 0.5 to about 3 moles of amino compound per equivalent of acylating agent. The number of equivalents of the acylating agent will vary with the number of carboxy groups present therein. In determining the number of equivalents of the acylating agent, those carboxyl functions which are not capable of reacting as a carboxylic acid acylating agent are excluded. In general, however, there is one equivalent of acylating agent for each carboxy group in the acylating agent.

It has been unexpectedly discovered, in at least one embodiment of the invention, that the use of acylated nitrogen containing compounds with relatively high TBNs in the lubricating oil composition tend to reduce the volatility of the phosphorus used therein. Accordingly, in one embodiment of the invention, the acylated nitrogen containing compound has a TBN of at least about 2, and in one embodiment from about 2 to about 30, and in one embodiment from about 5 to about 30, and in one embodiment about 10 to about 20.

The acylated nitrogen containing compound may be employed in the lubricating oil composition at a concentration in the range of about 1 to about 20% by weight, and in one embodiment about 1 to about 10% percent by weight, and in one embodiment about 1% to about 5% by weight.

Additional Lubricating Oil Additives

The lubricating oil composition may also contain other lubricant additives known in the art. These include, for example, corrosion-inhibiting agents, antioxidants, viscosity modifiers, dispersant viscosity index modifiers, pour point depressants, friction modifiers, antiwear agents other than those discussed above, EP agents other than those discussed above, dispersants other than those discussed above, detergents other than those discussed above, fluidity modifiers, copper passivators, anti-foam agents, etc. Each of the foregoing additives, when used, is used at a functionally effective amount to impart the desired properties to the lubricant. Generally, the concentration of each of these additives, when used, ranges from about 0.001% to about 20% by weight, and in one embodiment about 0.01% to about 10% by weight based on the total weight of the lubricating oil composition.

Concentrates and Diluents

The foregoing lubricating oil additives can be added directly to the base oil to form the lubricating oil composition. In one embodiment, however, one or more of the additives are diluted with a substantially inert, normally liquid organic diluent such as mineral oil, synthetic oil, naphtha, alkylated (e.g., $C_{10}$-$C_{13}$ alkyl) benzene, toluene or xylene to form an additive concentrate. These concentrates usually contain from about 1% to about 99% by weight, and in one embodiment 10% to 90% by weight of such diluent. The concentrates may be added to the base oil to form the lubricating oil composition.

EXAMPLES C-1 AND 1

Engine tests using the Sequence IIIF Test Procedure are conducted using the lubricating oil compositions identified in Table 1. Example 1 is within the scope of the invention, while Example C-1 is not within the scope of the invention but is provided for purposes of comparison. In Table I, unless otherwise indicated, all numerical values are in percent by weight.

TABLE I

| | Example | |
|---|---|---|
| | C-1 | 1 |
| Base oil: Mixture of two Group II base oils | | |
| (1) 4.5 $mm^2/s$ (cSt) @ 100° C., wt % | 90 | 90 |
| (2) 6.0 $mm^2/s$ (cSt) @ 100° C., wt % | 10 | 10 |
| Combined base oil viscosity, $mm^2/s$ (cSt) @ 100° C. | 4.6 | 4.6 |
| Combined base oil concentration | 81.35 | 81.22 |
| Viscosity modifier: LZ7070D available from Lubrizol identified as olefin copolymer dispersed in oil (91% diluent oil) | 8.00 | 8.00 |
| Pour point depressant: LZ7742 available from Lubrizol identified as a methacrylate copolymer dispersed with oil (35% diluent oil) | 0.15 | 0.15 |
| Dispersant: succinimide derived from polyisobutene (Mn = 2000) substituted succinic anhydride and polyethylene amines dispersed in oil, TBN = 15 (45% diluent oil) | 5.10 | 5.10 |
| Diluent oil | 0.50 | 0.50 |
| EP/antiwear additive: zinc dialkyl dithiophosphate derived from 60% iso-propyl alcohol and 40% 4-methyl-2-pentyl alcohol, TBN = 5 (9% diluent oil) | 0.73 | — |
| EP/antiwear additive: zinc dialkyl dithiophosphate derived from 4-methyl-2-pentyl alcohol, TBN = 5 (8% diluent oil) | — | 0.86 |
| Antioxidant: nonylated diphenyl amine | 1.0 | 1.0 |
| Antioxidant: sulfurized olefin containing 13.9% sulfur dispersed with oil (5% diluent oil) | 0.44 | 0.44 |
| Antioxidant: butyl acrylate substituted di-t-butyl phenol | 1.2 | 1.2 |
| Detergent: calcium sulfonate dispersed in oil, TBN = 300 (42% diluent oil) | 0.88 | 0.88 |
| Detergent: calcium sulfonate dispersed in oil, TBN = 400 (42% diluent oil) | 0.65 | 0.65 |
| Antifoam agent: polydimethylsiloxane dispersed in oil (87.5% diluent oil) | 89 ppm | 89 ppm |
| Viscosity Grade | 5W-30 | 5W-30 |
| Chemical analysis of oil at start of test | | |
| Ca | 0.1925 | 0.1947 |
| P | 0.0764 | 0.0685 |

During the course of each engine test the concentration of calcium and phosphorus in the crankcase oil is measured every ten hours. From these measurements the percent by weight of phosphorus retained in the crankcase (% $P_{retention}$) is calculated using the following formula:

$$\% P_{retention} = \left[\frac{(\% \text{ wt } P_t)(\% \text{ wt } M_{new})}{(\% \text{ wt } P_{new})(\% \text{ wt } M_t)}\right] \times 100$$

wherein:

% wt $P_t$ is the percent by weight of phosphorus in the lubricating oil composition in the crankcase at the end of t hours of testing using the Sequence III F Test Procedure;

% wt $M_{new}$ is the percent by weight of calcium in the lubricating oil composition in the crankcase at the beginning of testing using the Sequence III F Test Procedure;

% wt $P_{new}$ is the percent by weight of phosphorus in the lubricating oil composition in the crankcase at the beginning of testing using the Sequence III F Test Procedure; and % wt $M_t$ is the percent by weight of calcium in the lubricating oil composition at the end of t hours of testing using the Sequence III F Test Procedure.

The results of these engine tests are shown in FIG. 1. which is a plot of % $P_{retention}$ vs. time for each engine test. These results indicate a significant improvement in phosphorus retention for the lubricating oil composition used in Example 1 as compared to the lubricating oil composition used in Example C-1. The amount of phosphorus retained in the crankcase during operation of the engine is an indirect measurement of the amount of phosphorus lost from the crankcase with the exhaust gas. For example, in Example 1, after 50 hours of testing, 86.7% by weight of the phosphorus is retained in the crankcase oil, while 13.3% by weight is carried away with the exhaust gas. Similarly, with Example C-1, after 50 hours of testing, 69.2% by weight of the phosphorus is retained in the crankcase oil, while 30.8% is carried away with the exhaust gas. The exhaust gas generated in Example 1 is a lean-phosphorus containing exhaust gas, while the exhaust gas generated in Example C-1 is not a lean-phosphorus containing exhaust gas.

EXAMPLES 2-7

A series of lubricant formulations are prepared; each comprising:

about 84.5 percent by weight oil, predominantly API Group II base oils, overall viscosity 4.5 $mm^2/s$ (cSt) at 100° C.;

5 percent (including customary diluent oil) of olefin copolymer viscosity modifier(s);

0.15 percent (including diluent oil) of polymeric pour point depressant(s);

5.1 percent (including diluent oil) of succinimide dispersant(s);

0.4 percent of friction modifier(s);

2.0 percent antioxidant(s);

1.5 percent (including diluent oil) of overbased calcium and sodium detergents;

0.15 percent of molybdenum-containing antioxidant/friction modifier(s);

0.35 percent of corrosion inhibitor(s); and 100 ppm of commercial antifoam agent(s).

Each formulation also contains one or more zinc dialkyldithiophosphate EP/antiwear agents ("ZDPs"), in each instance providing 0.076 percent by weight phosphorus. The amounts and types of the ZPDs, in weight percent on an oil free-basis, are indicated in Table II.

TABLE II

| | Ex: | | | | | |
|---|---|---|---|---|---|---|
| | 2 | 3* | 4 | 5 | 6* | 7 |
| ZDP #1 | 0.18 | — | — | — | 0.69 | 0.30 |
| ZDP #2 | 0.61 | — | 0.27 | 0.41 | — | 0.47 |
| ZDP #3 | — | 0.77 | 0.52 | 0.39 | — | — |
| Mole % of "R" groups: | | | | | | |
| C3 | 16 | 60 | 40 | 30 | 60 | 26 |
| C6 | 84 | — | 33 | 50 | 40 | 74 |
| C8 | — | 40 | 27 | 20 | — | — |
| Avg. C per phosphorus acid moiety | 11.05 | 10.00 | 10.64 | 11.00 | 8.40 | 10.44 |
| PEI (mg P/L oil) | 15 | 45 | 30 | 19 | 39 | 16 |

*A comparative example

ZDP #1 - prepared using isopropanol (C3) and 4-methyl-2-pentanol (C6) (both secondary alcohols).

ZDP #2 - prepared using 4-methyl-2-pentanol

ZDP #3 - prepared using isopropanol and 2-ethylhexanol (a C8 primary alcohol).

The Mole % of "R" groups is the mole percent of all the hydrocarbyl groups having the indicated carbon number provided by all the ZDP component(s).

Also presented in Table II are the results of the Phosphorus Emissions Index Test (PEI) for each sample, expressed in terms of mg phosphorus per liter of oil. This test is based on the Selby modification of the Noack volatility test (ASTM D 5800), in which volatilized oil and phosphorus are collected in the receiver section of a Selby-Noack apparatus and the collected materials subjected to inductively-coupled plasma spectroscopy to determine the phosphorus concentration. The test is further described in T. W. Selby, "Development and significance of the Phosphorus Emission Index of Engine Oils," presented at 13$^{th}$ International Colloquium Tribology—Lubricants, Materials, and Lubrication, Technische Akademie Esslingen, Stuttgart/Osffildern, Germany, Jan. 15-17, 2002, available at http://www.savantgroup.com/PhosIndx-v2.PDF. Lower PEI values are considered better, and values of 20 or below are considered particularly good.

The results show that those samples with ZDP having on average 10.4 carbon atoms per phosphorus acid moiety exhibit lower phosphorus emissions. Those samples for which, additionally, the mole percent of hydrocarbyl groups supplied by the ZDP of C4 or less, is less than 34 percent, exhibit the lowest phosphorus emissions.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

The invention claimed is:

1. A method of lubricating an internal combustion engine and improving the efficiency of the emissions control system of the engine, the emissions control system being equipped with a catalyst containing exhaust gas after treatment device, the method comprising:

(A) selecting a lubricating oil composition comprising: a base oil; an alkali or alkaline earth metal-containing detergent; a metal salt of one or more phosphorus-containing compounds represented by the formula (I)

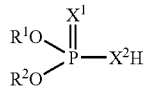

wherein in formula (I), $X^1$ and $X^2$ are independently O or S, and $R^1$ and $R^2$ are independently hydrocarbyl groups, the average total number of carbon atoms per phosphorus-containing moiety being at least 10.4, wherein at least one of the $R^1$ and $R^2$ groups in one or more of the phosphorus-containing compounds contains 4 or fewer carbon atoms and up to about 40 percent of all the $R^1$ and $R^2$ groups supplied by the phosphorus-containing metal salt contain 4 or fewer carbon atoms; and an acylated nitrogen containing compound having at least about 10 aliphatic carbon atoms and a TBN of at least about 2; the lubricating oil composition being characterized by a phosphorus concentration of up to about 0.12% by weight and the substantial absence of copper;

(B) adding the lubricating oil composition to the engine;

(C) operating the engine;

(D) generating a lean-phosphorus containing exhaust gas; and (E) contacting the catalyst in the exhaust gas after treatment device with the lean-phosphorus containing exhaust gas.

2. The method of claim 1 wherein during step (A) the weight ratio of detergent metal to phosphorus in the lubricating oil composition is from about 0.5:1 to about 10:1.

3. The method of claim 1 wherein the lubricating oil composition has a viscosity of up to about 16.3 $mm^2/s$ (cSt) at 100° C.

4. The method of claim 1 wherein the base oil comprises a mineral oil.

5. The method of claim 1 wherein the base oil comprises a poly-alpha-olefin or an oil derived from Fischer-Tropsch synthesized hydrocarbons or mixtures thereof.

6. The method of claim 1 wherein in formula (I), $X^1$ and $X^2$ are each S, and one of $R^1$ and $R^2$ is an alkyl or alkenyl group of about 6 to about 18 carbon atoms.

7. The method of claim 1 wherein in formula (I), $X^1$ and $X^2$ are each S, and one of $R^1$ and $R^2$ is an aromatic group.

8. The method of claim 1 wherein the metal used in the metal salt of a phosphorus containing compound is zinc.

9. The method of claim 1 wherein at least about 80% by weight of the phosphorus present in the lubricating oil composition is present in a compound represented by formula (I) wherein one of $R^1$ and $R^2$ is a hydrocarbyl group of about 6 to about 18 carbon atoms.

10. The method of claim 1 wherein the alkali or alkaline earth metal-containing detergent is a salt of an organic sulfur acid, carboxylic acid, lactone, phenol, or hydrocarbyl substituted saligenin.

11. The method of claim 1 wherein the alkali or alkaline earth metal-containing detergent is a salt of a linear oligomer or polymer containing unsubstituted or substituted phenol units and unsubstituted or substituted salicylic units.

12. The method of claim 1 wherein the alkali or alkaline earth metal is sodium, lithium or calcium.

13. The method of claim 1 wherein the acylated nitrogen-containing compound is derived from a carboxylic acylating agent and at least one amino compound containing at least one —NH— group, the acylating agent being linked to the amino compound through an imido, amido, amid me or salt linkage.

14. The method of claim 1 wherein the acylated nitrogen containing compound is a polyisobutene substituted succinimide.

15. The method of claim 1 wherein the lubricating oil composition further comprises a dispersant, corrosion-inhibiting agent, antioxidant, viscosity modifier, dispersant viscosity index modifier, pour point depressant, friction modifier, anti-wear agent, extreme pressure agent, fluidity modifier, copper passivator, anti-foam agent, or a mixture of two or more thereof.

16. The method of claim 1 wherein the lubricating oil composition is characterized by the substantial absence of magnesium.

17. A method of lubricating an internal combustion engine and improving the efficiency of the emissions control system of the engine, the emissions control system being equipped with a catalyst containing exhaust gas after treatment device, the method comprising: (A) selecting a lubricating oil composition comprising: a base oil; an alkali or alkaline earth metal-containing detergent, the alkali or alkaline earth metal being sodium, lithium or calcium; a zinc salt of a phosphorus-containing compound represented by the formula

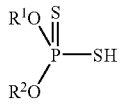

(II)

wherein $R^1$ and $R^2$ independently hydrocarbyl groups, the average total number of carbon atoms per phosphorus-containing moiety being at least 10.4, wherein at least one of the $R^1$ and $R^2$ groups in one or more of the phosphorus-containing compounds contains 4 or fewer carbon atoms and up to about 40 percent of all the $R^1$ and $R^2$ groups supplied by the phosphorus-containing metal salt contain 4 or fewer carbon atoms; at least about 80% by weight of the phosphorus present in the lubricating oil composition being present in a compound represented by formula (II) wherein one of $R^1$ and $R^2$ is a hydrocarbyl group of about 6 to about 18 carbon atoms; and a polyisobutene substituted succinimide having a TBN of about 5 to about 30, the polyisobutene substituent having a number average molecular weight in the range of about 700 to about 3000; the lubricating oil composition being characterized by a phosphorus concentration of no more than about 0.12% by weight and the substantial absence of copper; (B) adding the lubricating oil composition to the engine; (C) operating the engine; (D) generating a lean-phosphorus containing exhaust gas; and (E) contacting the catalyst in the exhaust gas after treatment device with the lean-phosphorus containing exhaust gas.

18. The method of claim 1 wherein less than 34 mole percent of all the $R^1$ and $R^2$ groups supplied by the phosphorus-containing metal salt contain 4 or fewer carbon atoms.

19. The method of claim 1 wherein the lubricating oil composition is characterized by a phosphorus content of up to about 0.08 percent by weight phosphorus.

20. The method of claim 1 wherein from about 16 to about 34 percent of all the $R^1$ and $R^2$ groups supplied by the phosphorus-containing metal salt contain 4 or fewer carbon atoms.

21. The method of claim 1 wherein up to about 40 percent of all the $R^1$ and $R^2$ groups supplied by the phosphorus-containing metal salt contain 4 or fewer carbon atoms and at least 60 mole percent of all the $R^1$ and $R^2$ groups supplied by the phosphorus-containing metal salt are derived from secondary alcohols.

22. The method of claim 1 wherein about 16 to about 34 percent of all the $R^1$ and $R^2$ groups supplied by the phosphorus-containing metal salt contain 4 or fewer carbon atoms and at least 60 mole percent of all the $R^1$ and $R^2$ groups supplied by the phosphorus-containing metal salt are derived from secondary alcohols.

23. A method of lubricating an internal combustion engine and improving the efficiency of the emissions control system of the engine, the emissions control system being equipped with a catalyst containing exhaust gas after treatment device, the method comprising: (A) selecting a lubricating oil composition comprising: a base oil; an alkali or alkaline earth metal-containing detergent; a metal salt of one or more phosphorus-containing compounds represented by the formula

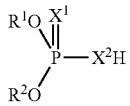

(I)

wherein in formula (I), $X^1$ and $X^2$ are independently O or S, and $R^1$ and $R^2$ are independently hydrocarbyl groups, the average total number of carbon atoms per phosphorus-containing moiety being at least 10.4, wherein at least one of the $R^1$ and $R^2$ groups in one or more of the phosphorus-containing compounds contains 4 or fewer carbon atoms and up to about 40 percent of all the $R^1$ and $R^2$ groups supplied by the phosphorus-containing metal salt contain 4 or fewer carbon atoms, and at least 60 mole percent of all the $R^1$ and $R^2$ groups supplied by the phosphorus-containing metal salts are derived from secondary alcohols; and an acylated nitrogen containing compound having at least about 10 aliphatic carbon atoms and a TBN of at least about 2; the lubricating oil composition being characterized by a phosphorus concentration of up to about 0.12% by weight and the substantial absence of copper; (B) adding the lubricating oil composition to the engine; (C) operating the engine; (D) generating a lean-phosphorus containing exhaust gas; and (E) contacting the catalyst in the exhaust gas after treatment device with the lean-phosphorus containing exhaust gas.

* * * * *